US006052136A

United States Patent [19]

Tanioka et al.

[11] Patent Number: 6,052,136

[45] **Date of Patent: *Apr. 18, 2000**

[54] COLOR IMAGE FORMING APPARATUS AND METHOD FOR MANUFACTURING RECORDING HEAD USED IN COLOR IMAGE FORMING APPARATUS

[75] Inventors: Hiroshi Tanioka, Yokohama; Toshihiko Otsubo, Numazu; Mitsuru Amimoto, Yokohama; Mitsuo Shiraishi, Shizuoka-ken, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/864,902

[22] Filed: May 29, 1997

[30] Foreign Application Priority Data

May 30, 1996 [JP] Japan ..... 8-136062

[51] Int. Cl.[7] ..... H01J 9/00; B41J 2/45; G03G 15/01

[52] U.S. Cl. ..... 347/118; 347/238; 445/24

[58] Field of Search ..... 347/232, 238, 347/115, 116, 236, 43, 117, 118, 172, 173; 257/93, 94, 103, 89; 438/22, 23, 28, 29, 30, 68; 29/469; 372/43; 250/330–332; 445/22, 24

[56] References Cited

U.S. PATENT DOCUMENTS

| | | | |
|---|---|---|---|
| 4,936,808 | 6/1990 | Lee | 445/24 |
| 4,982,203 | 1/1991 | Uebbing et al. | 347/236 |
| 5,444,525 | 8/1995 | Takahashi et al. | 347/115 |
| 5,510,633 | 4/1996 | Orlowski et al. | 357/93 |
| 5,691,760 | 11/1997 | Hosier et al. | 347/238 |

*Primary Examiner*—N. Le
*Assistant Examiner*—L. Anderson
*Attorney, Agent, or Firm*—Fitzpatrick, Cella, Harper & Scinto

[57] ABSTRACT

The present invention provides a color image forming apparatus comprising a plurality of color recording heads each having a plurality of recording chips for effecting the recording in response to an image signal. Features of the recording chips attached to the recording head for forming a yellow image differ from features of the recording chips attached to the other color recording heads.

12 Claims, 4 Drawing Sheets

COLOR IMAGE FORMING APPARATUS AND METHOD FOR MANUFACTURING RECORDING HEAD USED IN COLOR IMAGE FORMING APPARATUS

BACKGROUND OF THE INVENTION

1. Field of the Invention

The present invention relates to an image forming apparatus such as a color copying machine, facsimile machine, printer and the like, and more particularly, it relates to an image forming apparatus for forming an image by using a plurality of discrete recording heads and a method for manufacturing such recording heads.

2. Related Background Art

In such image forming apparatuses, particularly in order to permit compact and high speed recording by utilizing electrophotography, a recording portion has been constituted by a plurality (same as the number of photosensitive drums) of discrete recording elements (for example, light emitting element arrays such as LED arrays, light permeability controlling element arrays such as liquid crystal shutters, element arrays capable of controlling light reflection, or the like) or by direct recording system such as an ink jet recording system.

In such a recording portion, since a plurality of recording element chips are cut from a single wafer and a recording head is formed by straightly arranging a plurality of such recording element chips, it is desirable that such recording element chips have the same recording features.

However, in the single wafer, fundamentally, since there are differences in features of wafer itself and in features due to manufacturing process between end portions and a central portion of the wafer, it is difficult to form all of the recording element chips to have satisfactory good performance, and, thus, the number of actually available recording element chips is decreased, thereby making the recording head expensive.

SUMMARY OF THE INVENTION

The present invention intends to eliminate the above-mentioned conventional drawback, and has an object to provide an image forming apparatus in which a recording head can be made cheaper by increasing yield of a wafer.

Another object of the present invention is to provide a color image forming apparatus which includes a plurality of recording heads each having a plurality of recording chips and in which features of the recording chips attached to a recording head for forming a yellow image differ from features of the recording chips attached to the other recording heads.

A further object of the present invention is to provide a method for manufacturing a recording head comprising the steps of forming a plurality of light emitting elements on a wafer, dicing the wafer to form recording chips, sorting the recording chips in accordance with light emitting features, and mounting the recording chips not having a predetermined light emitting feature reference on a yellow recording head and mounting the recording chips having the predetermined light emitting feature reference on the other recording heads.

This other objects of the present invention will be apparent from the following detailed description referring to the accompanying drawings.

DETAILED DESCRIPTION OF THE PREFERRED EMBODIMENTS

Figure 1:
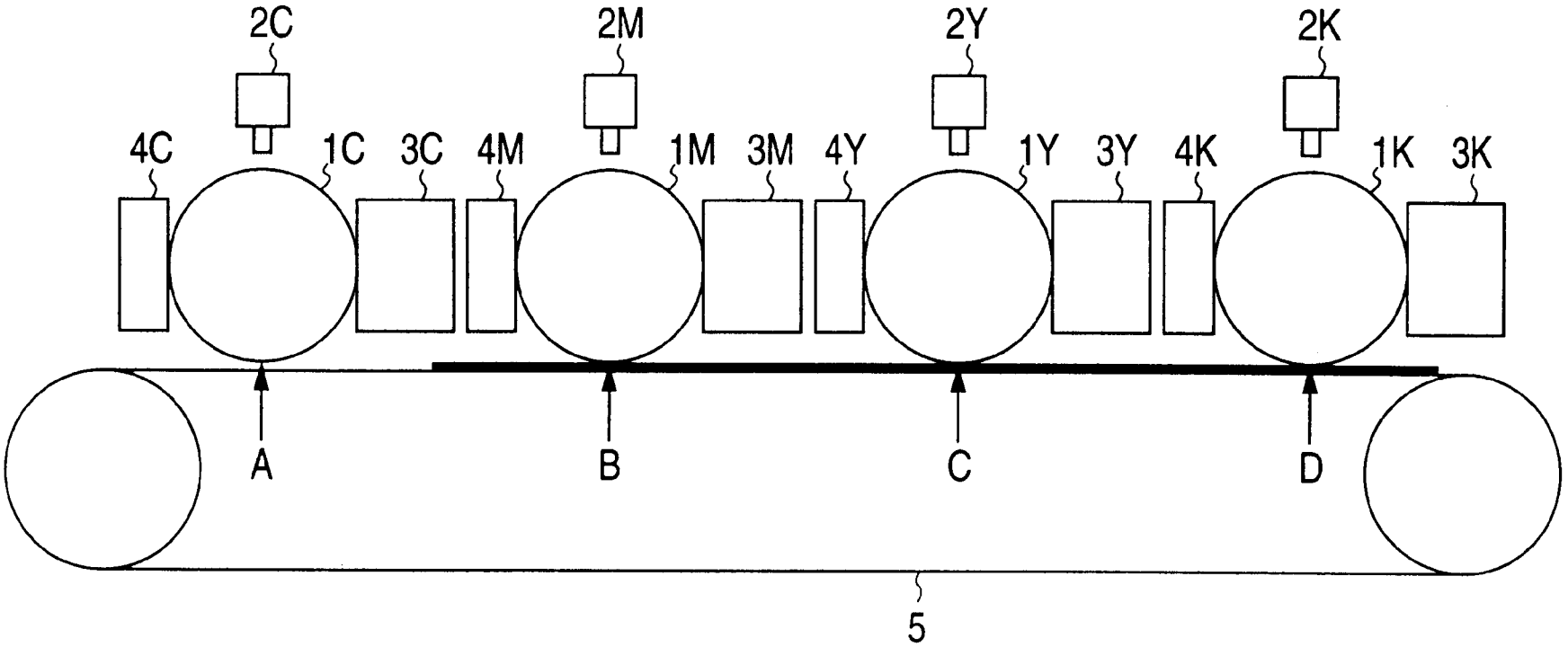
FIG. 1 is a schematic view showing a main portion of an image forming apparatus according to the present invention.

FIG. 1 is a schematic view showing a main portion of an image forming apparatus according to the present invention. In such an image forming apparatus, four photosensitive drums 1C, 1M, 1Y and 1K are arranged side by side, around which there are disposed LED recording heads 2C, 2M, 2Y and 2K, developing devices 3C, 3M, 3Y and 3K, and cleaners 4C, 4M, 4Y and 4K, respectively. Further, a transfer belt 5 is disposed below the photosensitive drums.

In response to color record signals from the LED recording heads 2C, 2M, 2Y and 2K, respective latent images are formed on the photosensitive drums 1C, 1M, 1Y and 1K, respectively. These latent images are developed by the developing devices 3C, 3M, 3Y and 3K, respectively, to form a cyan toner image, a magenta toner image, an yellow toner image and a black toner image, respectively. These toner images are transferred onto a recording sheet P carried by the transfer belt 5 at positions A, B, C and D, respectively.

By the way, although not shown, each of four LED recording heads 2C, 2M, 2Y and 2K is constituted by straightly arranging fifty-five LED chips each having 128 light emitting elements straightly disposed with density of 600 DPI. Thus, each recording head has 7040 light emitting elements.

It was found that it is possible to form 128 light emitting elements in the single LED chip so that dispersion in light emitting intensity of these light emitting elements can be included within about 10% of an average value.

On the other hand, when an image is formed by a recording head having uneven output, density unevenness occurs in the image. The higher the spatial frequency the harder the visibility of the density unevenness. To the contrary, as most noticeable density unevenness, there is unevenness in one chip cycle, i.e., about 5.4 mm pitch (corresponding to a length of one chip) density unevenness is most noticeable. Further, when the recording heads having the same light emitting intensity unevenness were used, it was found that the yellow image on the recording sheet is most hard to be noticeable.

Accordingly, in the present invention, the light emitting features of the LED chips are sorted into two groups, and LED chips (in one group) having great unevenness which cannot be available are used as chips for exclusively forming the yellow image. Thus, such fifty-five LED chips are arranged straightly to form the yellow recording head. The cyan, magenta and black recording heads are constituted by the other LED chips having small unevenness. Accordingly, the single image forming apparatus has two kinds of recording heads.

Now, a reference for sorting all of the LED chips into sixteen ranks on the basis of the measured light emitting intensity values representative of light emitting features will be explained.

Average light emitting intensity P per chip is defined by the following equation:

$$P=(\Sigma P(x))/128 \quad (x=1, 2, \ldots, 128)$$

where, P(x) is x-th element in 128 light emitting elements.

Further, intermediate frequency unevenness M (%) representative of the light emitting unevenness is defined by the following equation:

$$M=100\times\{\mathrm{MAX}(Q(x))-\mathrm{MIN}(Q(x))\}/P$$

where, Q(x) is an average weighting value obtained from outputs P(x) of adjacent seven elements around any element x. That is to say, Q(x) is defined by the following equation:

$$Q(x)=(\Sigma m(i)\times P(x+i))/7\ (i=-3, -2, \ldots, 3)$$

Further, weighting coefficients m(i) include seven coefficients, and the total of these coefficients becomes one (1) to accommodate human's visibility. Incidentally, if the elements are situated at an end portion, the weighting coefficient of the outermost element or an average weighting coefficient is used as the weighting coefficients of the elements.

In addition, MAX(Q(x)) and MIN(Q(x)) are maximum and minimum values of values Q(x) among all of 128 elements in one chip.

Low frequency unevenness L(%) is determined from values Q(s), Q(c), Q(e) (defined by the following equations) obtained by average values of fourteen end elements and fourteen central elements by using the seven element weighting average value Q(x):

$$Q(s)=(\Sigma Q(x))/14\ (x=1, 2, \ldots, 14)$$

$$Q(c)=(\Sigma Q(x))/14\ (x=57, 58, \ldots, 70)$$

$$Q(e)=(\Sigma Q(x))/14\ (x=115, 116, \ldots, 128)$$

$$L=100\times\{\mathrm{MAX}(Q(s), Q(c), Q(e))-\mathrm{MIN}(Q(s), Q(c), Q(e))\}/P$$

TABLE 1

| Rank | Unevenness L, M | | P = average output (deviation from average value per wafer) |
|---|---|---|---|
| 1 | L < 3.0 | M < 7.0 | −3.0%—2.5% |
| 2 | L < 3.0 | M < 7.0 | −2.5%—2.0% |
| 3 | L < 3.0 | M < 7.0 | −2.0%—1.5% |
| 4 | L < 3.0 | M < 7.0 | −1.5%—1.0% |
| 5 | L < 3.0 | M < 7.0 | −1.0%—0.5% |
| 6 | L < 3.0 | M < 7.0 | −0.5%–0% |
| 7 | L < 3.0 | M < 7.0 | +0.5%–0% |
| 8 | L < 3.0 | M < 7.0 | +1.0%—+0.5% |
| 9 | L < 3.0 | M < 7.0 | +1.5%—+1.0% |
| 10 | L < 3.0 | M < 7.0 | +2.0%—+1.5% |
| 11 | L < 3.0 | M < 7.0 | +2.5%—+2.0% |
| 12 | L < 3.0 | M < 7.0 | +3.0%—+2.5% |
| 13 | L < 7.0 | M < 15.0 | 0%—−5% |
| 14 | L < 7.0 | M < 15.0 | −5%—−10% |
| 15 | L < 7.0 | M < 15.0 | 0%—+5% |
| 16 | L < 7.0 | M < 15.0 | +5%—+10% |

The distribution of average light amount P of chips obtained from the single wafer in the manufacture process is regular distribution (4ρ=10%), and, accordingly, about 75% of all the chips obtained from the single wafer have deviation within 3%. Further, regarding the unevenness M, about 80% of the chips are included within 7%, and, regarding the unevenness L, about 70% of the chips are included within 3%.

Accordingly, when the fifty-five chips included in any rank from the rank 1 to the rank 12 are mounted on the recording head, the fifty-five LED chips in each recording head, i.e., 7040 elements have light emitting unevenness within 3.5% (=3+0.5) for low frequency, and within 7.5% (=7+0.5) for intermediate frequency. Thus, even when such a recording head is used for forming cyan, magenta and black images other than the yellow image, the recording unevenness cannot be found visually.

On the other hand, when the fifty-five chips included in any rank from the rank 13 to the rank 16 are mounted on the recording head, the fifty-five LED chips in each recording head, i.e., 7040 elements have light emitting unevenness within 12% (=7+5) for low frequency, and within 20% (=15+5) for intermediate frequency. Thus, when such a recording head is used for forming the yellow image, the recording unevenness cannot be found visually.

Although the LED chips obtained from the peripheral portion of the water have the great unevenness L for low frequency, since all of these chips can exclusively used for the recording heads for forming the yellow image, all of the recording heads including other color recording heads can be made cheaper.

Figure 3:
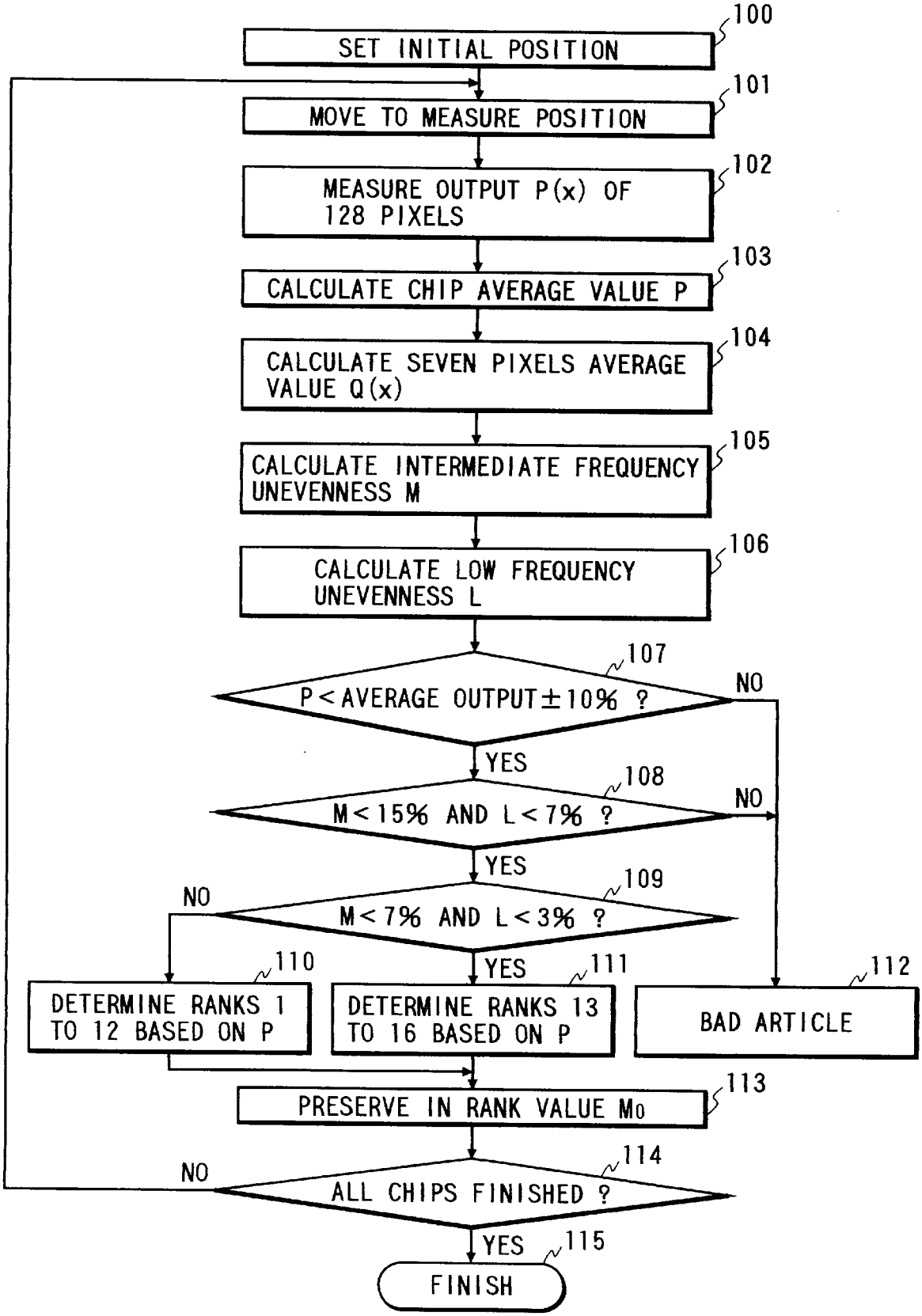
FIG. 3 is a flow chart showing a process for ranking LED chips.

Next, a process for ranking the LED chips will be explained with reference to a flow chart shown in FIG. 3.

In general, after a hundred chips are formed on a wafer, prior to dicing, the light emitting elements are illuminated by applying energy to pads of the light emitting elements in each chips by using a so-called IC prober card, and light emitting intensity of each pixel element is measured by a sensor in the card. The sensor is a calibrated photo-sensor, and, thus, high speed measurement can be realized by using a solid-state image sensor.

First of all, a stage is shifted to a predetermined position on the wafer (steps 100, 101). All of the outputs P(x) of 128 pixels in the chip (step 102) and the average output P of the chip is determined by simple adding calculation (step 103). On the basis of the average value, the seven pixels weighting average value Q(x) is determined (step 104), and the intermediate frequency unevenness M is calculated on the basis of the maximum value MAX(Q(x)) and the minimum value MIN(Q(x)) and the average output P (step 105). Similarly, the low frequency unevenness L is calculated (step 106).

It is judged whether the obtained average output P is included within a range of ±10% of the allowable average value, thereby discriminating bad chips (step 107). Similarly, bad chips are discriminated on the basis of the frequency unevenness M, L (steps 108, 112). Incidentally, normally, in this process, the bad or poor chips include crack, scratch and/or dirt.

Then, it is judged whether the chip can be used in the formation of cyan, magenta and black images on the basis of the frequency unevenness M, L (step 109), and the rank corresponding to the output value P is determined among the ranks 1 to 12 (step 110). On the other hand, regarding the yellow image chip, the rank of the chip is similarly determined among the ranks 13 to 16 (step 111).

The determined rank values are recorded on a photomagnetic disc Mo connected to the manufacturing apparatus together with a wafer number of the chip and positional information (step 113). Similar processing is carried out for all of the chips of the same wafer to record respective data. Then, the dicing process is effected.

Figure 4:
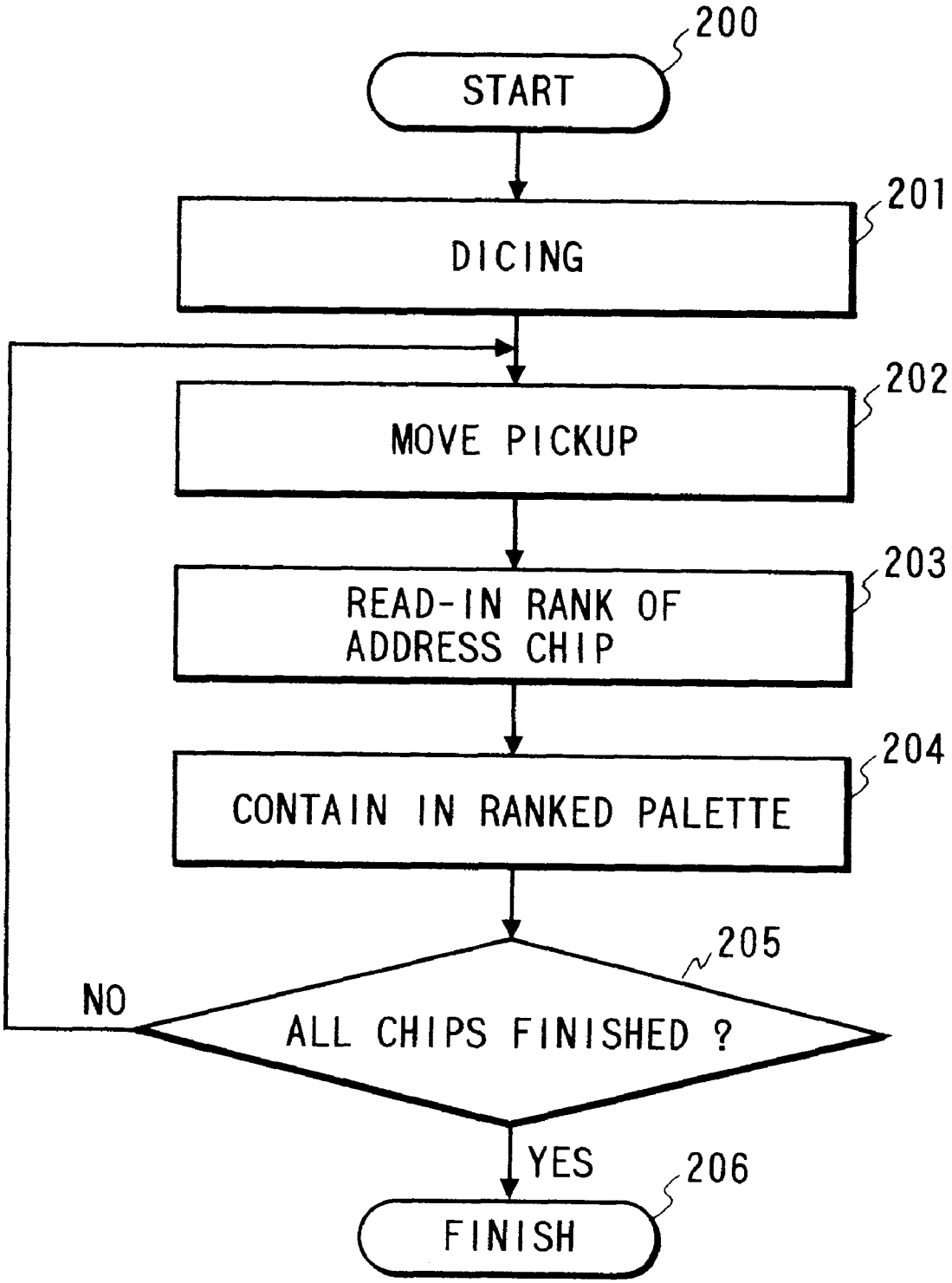
FIG. 4 is a flow chart showing a dicing process.

Next, the dicing process will be explained with reference to a flow chart shown in FIG. 4. In the dicing process, first of all, the wafer is cut to obtain the chips (step 201), and the chips are contained in pallets for corresponding ranks by a collet.

The stage is shifted to the predetermined position (step 202), and the rank situated at that position is read out from the disc (step 203). Then, the chip is picked-up and contained in the pallet corresponding to that rank (step 204). Similar procedure is effected for all of the chips. Incidentally, explanation of a visual checking process and the like will be omitted.

By the way, when the chips are mounted on the recording head, the pallet corresponding to the head color to be manufactured is selected, and the chips are successively picked up from that pallet and die-bonded. Theoretically, although the LED chips formed from the peripheral portion of the wafer have great low frequency unevenness L, since such LED chips can be exclusively used for the yellow recording head, the yield of the wafer is increased to achieve "cost-down".

Next, interchangeability of the recording head will be explained.

The recording heads sorted into sixteen ranks has a marking (formed on a base member of the head) corresponding to the rank. The markings aim to prevent the formation of recording unevenness due to the fact that the yellow recording head (ranks 13 to 16) is erroneously used as the cyan, magenta or black recording head. Accordingly, the base member of the yellow recording head may be provided with a projection (as shown in FIGS. 2A and 2B) different from those of the other color recording heads to inhibit mechanical interchangeability between the yellow recording head and the other color recording heads.

Figure 2A:
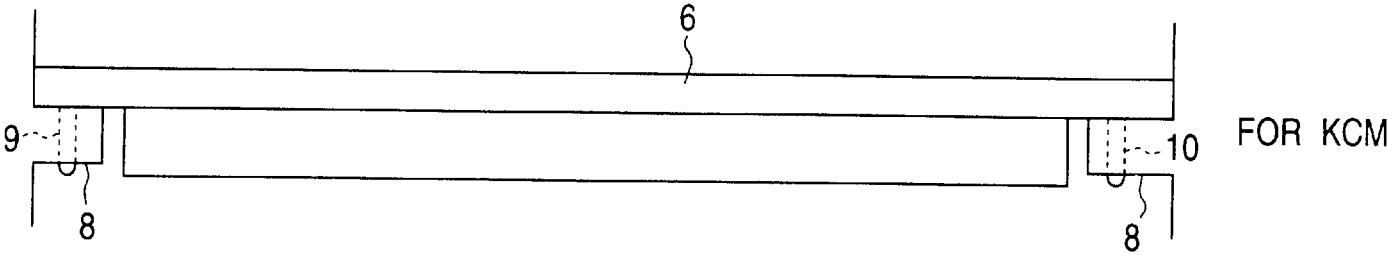
FIGS. 2A and 2B are views showing an example of a construction for inhibiting mechanical interchangeability of recording heads.
Figure 2B:
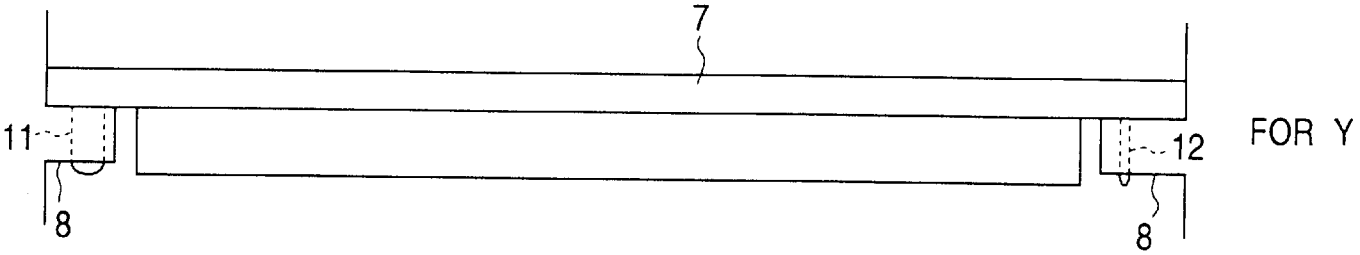

An example of a construction for inhibiting the mechanical interchangeability is shown in FIGS. 2A and 2B. The base member 6 of the other color (KCM) recording head and the base member 7 of the yellow (Y) recording head are provided at their both ends with positioning pins 9, 10 and 11, 12, respectively, for fitting into holes formed in a side plate 8 of the apparatus. Diameters of the pins 9, 10 of the base member 6 of the KCM recording head are the same as each other, whereas, a diameter of the pin 11 of the base member 7 of the Y recording head is greater than a diameter of the other pin 12. Accordingly, the Y recording head cannot be mounted on the KCM stage because of the large pin 11. Incidentally, the photosensitive drum are disposed above and below the base members 6 and 7 regarding the plane of FIGS. 2A and 2B.

Incidentally, since the difference in average output between the recording heads in each rank is 20% at the maximum, energy for driving the elements of the recording head is adjusted in accordance with the rank. That is to say, a drive current value, a drive voltage value and a drive pulse width may be adjusted on the basis of the ranks 6 and 7. Further, the rank value can be read by a CPU of the recording apparatus as 4-bit electric signal from the recording head.

In the illustrated embodiment, while an example that the LED recording head is used as a recording head was explained, the present invention is similarly applicable to an image forming apparatus of ink jet recording type.

As mentioned above, according to the present invention, when a plurality of recording heads are used for effecting the color recording, since the recording element chips having uneven recording feature and great light emitting unevenness can be used in the recording head for forming the yellow image which is unnoticeable visually, the yield of the wafer can be increased, thereby making the all of the recording heads cheaper.

The present invention is not limited to the illustrated embodiment, but, various alterations and modifications can be made within the scope of the invention.

What is claimed is:

1. A color image forming apparatus for forming a color image by superposing at least a yellow image, a magenta image and a cyan image, comprising:

a plurality of color recording heads for effecting the recording in response to an image signal, each of the color recording heads having a plurality of recording chips, each of the recording chips having a luminescence characteristic;

wherein the luminescence characteristics of the recording chips attached to the head for forming a yellow image differ from the luminescence characteristics of the recording chips attached to the magenta and cyan color recording heads.

2. A color image forming apparatus according to claim 1, wherein each said recording chip includes a plurality of light emitting elements, and a degree of a lack of uniformity of a light emitting distribution of each of said recording chips attached to said yellow color recording head is greater than that of said recording chips attached to the other color recording heads.

3. A color image forming apparatus according to claim 1, wherein each said recording chip includes a plurality of light emitting elements, and an average value of a light emitting intensity of the plurality of light emitting elements of said recording chips attached to said yellow color recording head is smaller than that of the light emitting elements of said recording chips attached to the other color recording heads.

4. A color image forming apparatus according to claim 2 or 3, wherein said light emitting element is a light emitting diode.

5. A color image forming apparatus according to claim 1, wherein said recording chip is formed by dicing a wafer.

6. A color image forming apparatus according to claim 1, further comprising photosensitive members for respective colors exposed by the corresponding recording heads, and developing means for respective colors for supplying developing agent to the corresponding photosensitive members, so that developing agent images formed on said photosensitive members are superimposed on a recording material to form a color image.

7. A color image forming apparatus according to claim 6, further comprising an erroneous mount preventing means for preventing said yellow color recording head from being mounted on a mounting position for the other color recording heads.

8. A method for manufacturing a recording head used in a color image forming apparatus, comprising the steps of:

forming a plurality of light emitting elements on a wafer;

dicing the wafer to form a plurality of recording chips, each of the recording chips having a luminescence characteristic;

sorting the recording chips in accordance with the luminescence characteristics of the recording chips; and mounting the recording chips not having a predetermined luminescence characteristic reference on a yellow recording head and mounting the recording chips having the reference on the remaining color recording heads.

9. A color image forming apparatus for forming a color image by superposing at least a yellow image, a magenta image and a cyan image, comprising:

a plurality of recording heads for effecting a recording in response to an image signal, said recording heads forming, respectively, said yellow image, said magenta image and said cyan image, each said recording head having a recording characteristic, wherein the recording characteristic of said recording head for forming the yellow image differs from the recording characteristics of said recording heads for forming the magenta image and the cyan image.

10. A color image forming apparatus according to claim 9, wherein said recording heads each have a row of light emitting elements for emitting light in response to an image signal, and the recording characteristics of said recording heads are luminescence characteristics.

11. A color image forming apparatus according to claim 10, wherein said light emitting elements are light emitting diodes.

12. A color image forming apparatus according to claim 10, further comprising:

a plurality of photosensitive members for respective said colors exposed by the corresponding recording heads; and developing means for respective said colors for supplying a developing agent to the corresponding photosensitive members, so that developing agent images formed on said photosensitive members are superimposed on a recording material to form the color image.

* * * * *

UNITED STATES PATENT AND TRADEMARK OFFICE

CERTIFICATE OF CORRECTION

PATENT NO. : 6,052,136

DATED : April 18, 2000

INVENTOR(S) : HIROSHI TANIOKA ET AL.

It is certified that error appears in the above-identified patent and that said Letters Patent is hereby corrected as shown below:

COLUMN 3

Line 59, "(4ρ = 10%), should read --(4σ = 10%).

COLUMN 4

Line 16, "water" should read --wafer--;
Line 17, "can" should read --can be--;
Line 26, "chips" should read --chip--.

COLUMN 5

Line 17, "has a" should read --have--;
Line 40, "drum" should read --drums--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*